United States Patent [19]

Piesik

[11] Patent Number: 4,796,510

[45] Date of Patent: Jan. 10, 1989

[54] ROCKET EXHAUST RECIRCULATION OBTURATOR FOR MISSILE LAUNCH TUBE

[75] Inventor: Edward T. Piesik, Pomona, Calif.

[73] Assignee: General Dynamics, Pomona Division, Pomona, Calif.

[21] Appl. No.: 118,674

[22] Filed: Nov. 9, 1987

[51] Int. Cl.[4] ..... F41F 3/04

[52] U.S. Cl. ..... 89/1.816; 89/1.8; 89/1.809

[58] Field of Search ..... 89/1.816, 1.809, 1.810, 89/1.8

[56] References Cited

U.S. PATENT DOCUMENTS

| | | | |
|---|---|---|---|
| 2,998,754 | 9/1961 | Bialy | 89/1.816 |
| 3,146,669 | 9/1964 | Wolf | 89/1.816 |
| 3,182,554 | 5/1965 | Barakauskas | 89/1.809 |
| 3,289,533 | 12/1966 | Brown | 89/1.809 |
| 4,044,648 | 8/1977 | Piesik | 89/1.816 |
| 4,186,647 | 2/1980 | Piesik | 89/1.8 |
| 4,324,167 | 4/1982 | Piesik | 89/1.8 |
| 4,399,999 | 8/1983 | Wold | 89/1.816 |
| 4,433,848 | 2/1984 | Williams | 89/1.816 |
| 4,464,972 | 8/1984 | Simon | 89/1.816 |
| 4,485,719 | 12/1984 | Mendelsohn et al. | 89/1.816 |
| 4,604,940 | 8/1986 | Mendelsohn et al. | 89/1.816 |
| 4,686,884 | 8/1987 | Piesik | 89/1.816 |

*Primary Examiner*—David H. Brown

*Attorney, Agent, or Firm*—Edward B. Johnson; Neil F. Martin

[57] ABSTRACT

A rocket exhaust recirculation obturator or cover member is designed to extend across the base of a missile in a launch tube between the exit nozzle of the missile rocket exhaust and the walls of the launch tube. The cover member has a central opening which seals against the rocket motor nozzle exit, and an outer periphery which seals against the launch tube walls. During launch, pressure of exhaust gases recirculating back up the launch tube will urge the obturator against the base of the missile, and both the missile and obturator will accelerate together up the launch tube. A release assembly is provided at the upper end of the launch tube which engages corresponding release devices at the outer periphery of the obturator. The engagement releases the pressure bond between the obturator, the missile base, and the launch tube. This allows the rocket exhaust to impinge upon the upper surface of the obturator in opposition to the obturator's momemtum. The exhaust impingement forces the obturator back down the launch tube, eliminating debris outside the launch tube.

5 Claims, 2 Drawing Sheets

ROCKET EXHAUST RECIRCULATION OBTURATOR FOR MISSILE LAUNCH TUBE

BACKGROUND OF THE INVENTION

The present invention relates generally to an apparatus for sealing the space between a missile or rocket and missile launch tube prior to and during launch of the missile to prevent or restrict the flow of recirculating exhaust gases into the tube area around the rocket itself.

Rockets, missiles or other exhaust-gas propelled vehicles are often stored in launch tubes or containers from which they are ejected on launch. The inner diameter or dimension of the launch tube or container is normally larger than the outside dimensions of the missile or vehicle. Thus seals have been proposed in the past to prevent leakage of exhaust gases into the space between the missile and launch tube during launch and to retain the pressure generated by the exhaust gases in the space behind the missile.

In U.S. Pat. No. 4,399,999 of Wold, for example, a segmented annular seal is provided between the outer diameter of the missile and the inner surface of the launch tube. The seal travels up the launch tube with the missile and will be ejected with it, resulting in debris around the launch tube. Also, this arrangement provides no protection of the base region of the missile.

U.S. Pat. No. 4,324,167 of Piesik shows a rear cover for a rocket launch tube which provides a seal between the tube and the rear end of the rocket. The cover is fixed at the bottom of the launch tube and protects the base of the rocket only prior to movement up the tube. Once the rocket starts to move up the tube on launch, the cover separates from the rocket and thus exhaust gases can escape while the base of the rocket is unprotected.

SUMMARY OF THE INVENTION

It is an object of the present invention to provide an improved sealing arrangement for a missile or rocket launch tube.

According to the present invention a rocket exhaust recirculation obturator is provided, which comprises a cover member for extending across the rear end of a vehicle up to the walls of the launch tube. The cover member has at least one central opening for sealing against the rocket motor nozzle exit of the vehicle, and an outer periphery for sealing against the walls of the launch tube.

The apparatus preferably includes a release assembly for preventing the cover member from leaving the launch tube with the vehicle. In a preferred arrangement, the cover member is provided with a release assembly at its outer periphery which is caught by corresponding formations adjacent the top end of the launch tube as the vehicle exits the tube, so that relative motion with rocket exhaust impingement causes the cover member to be retained in the tube.

With this arrangement, the cover member is urged against the base region of the rocket by the pressure of the recirculating exhaust gases and travels up the tube with the rocket until it is released by the release assembly. In a preferred embodiment, the cover member has spaced release rings at its outer periphery and the launch tube has corresponding hooks adjacent its upper end for engaging the release rings when the cover member arrives at that point in the tube.

Thus the cover member prevents or restricts exhaust gases from backflowing around a missile or other rocket propelled vehicle during its travel along a launch tube or container, and also protects the base region of the vehicle from the recirculating gases during launch or during a restrained firing without launch.

The cover member may be of a lightweight semi-flexible construction and is of an ablative material capable of withstanding the heat of the exhaust gases and the pressure in the exhaust tube during launch or during a restrained firing without launch. Alternatively, it may be of semirigid or rigid construction, comprising a laminated metallic substructure which is embedded in a suitable ablative material. This will add to the rigidity of the structure so that it will be self-supporting in the launch tube prior to launch. The metallic substructure is preferably scored or in segments so that it can deform its center one released from the missile base.

In a preferred embodiment of the invention, the release rings are secured to the central opening via connecting lines or lanyards, each secured at one end to a respective one of the rings and at the opposite end to the area around the central opening of the cover member. The lines are adhesively secured to the undersurface of the cover member, or may be embedded in the ablative material of the cover member so that they are protected from the exhaust gases during launch. They may comprise metallic wires or the like.

With this arrangement, when the release rings are caught on the hooks, the rings and lines will tear away from the undersurface of the cover member. Once the securing lines tethering the center of the cover member to the hooks become taut, the cover member will start to distort near the rocket nozzle.

Exhaust gases will immediately impinge on the nozzle lip seal, decelerating this part of the obturator at the same time the rest of the obturator is still accelerating. This action distorts the obturator breaking the pressure bond at the launch tube surface. The distortion relieves the upward pressure on the obturator and the obturator acceleration decays. The relative motion of the missile and obturator now causes the rocket exhaust to engulf the obturator more and more. The obturator is stopped; then accelerated back down the launch tube. No obturator debris leaves the launch tube.

Preferably, all of the release rings are captured on the hooks; but it is sufficient that if as few as one lanyard is tethered to the center of the cover member, the action will occur essentially as described above.

It should be understood that the preferred arrangement concerns rocket nozzle flows described as 'underexpanded', that is the nozzle exit pressure is greater than the pressure immediately around the nozzle exit. Thus the nozzle flow expands as it leaves the nozzles to this lower pressure.

The described arrangement will still function for "overexpanded" nozzle flow, but the lanyards must cause a greater separation of the obturator center region from the missile base before the less expanded exhaust will begin to impinge on the lip seal. The loads on the "hooks" will increase because more of the obturator momentum must be absorbed before the exhaust impingement takes effect.

Prior to launch, the obturator or cover member will remain in place as long as the rocket is stationary. When the rocket is ignited, the cover member will initially move toward the rocket and seal around the nozzle exit and the launch tube due to the pressure forces of the recirculating exhaust gases acting on the lower surface of the member. This will augment the normal thrust of the rocket, prevent exhaust gases from flowing around the rocket, and protect the base area of the rocket. The cover member is released prior to exit from the tube so that no debris is left around the launch tube.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
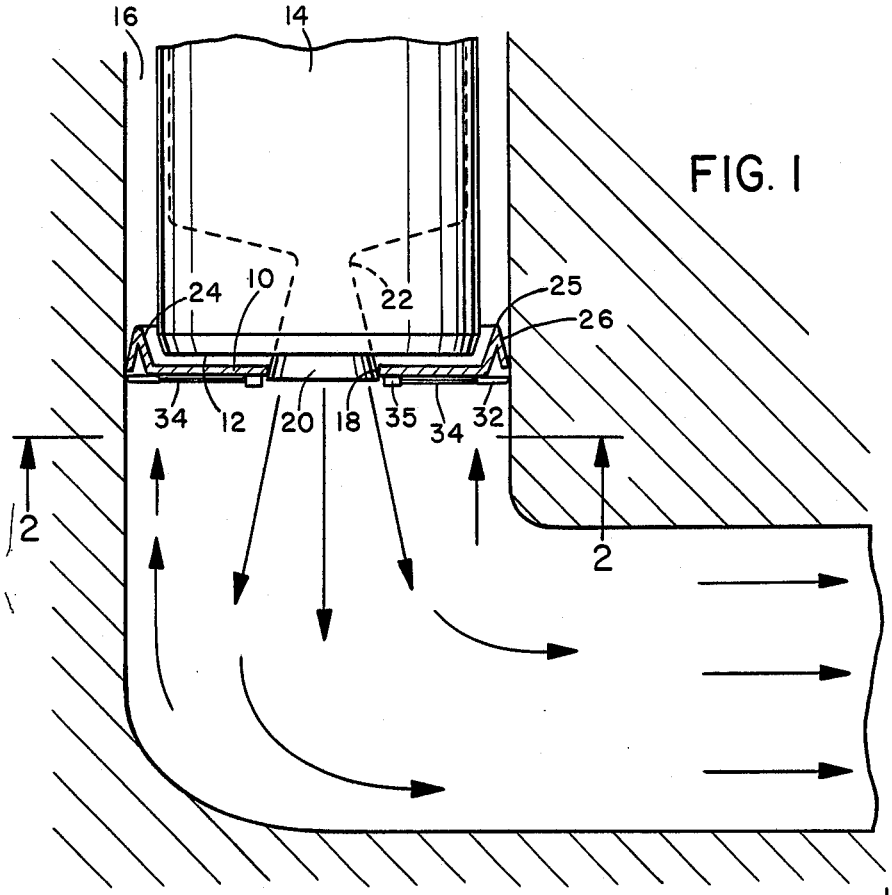
FIG. 1 is a sectional view through a missile launch tube showing the initial deployment of an obturator according to a preferred embodiment of the present invention.
Figure 2:
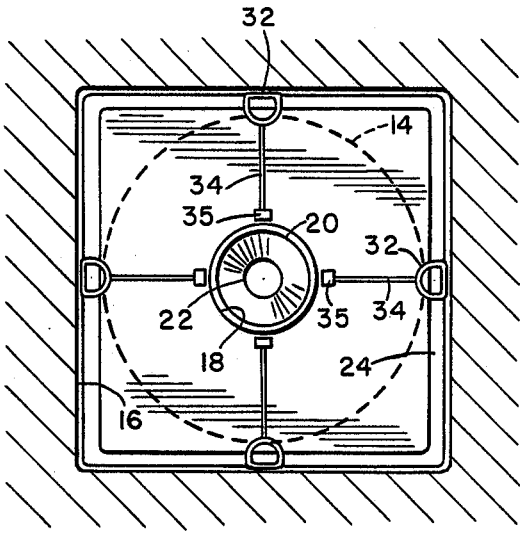
FIG. 2 is a sectional view taken on the line 2—2 of FIG. 1.

FIGS. 1 and 2 of the drawings show a rocket exhaust recirculation obturator or cover member 10 according to a preferred embodiment of the present invention which is designed to seal against the base 12 of a missile or other exhaust-gas propelled vehicle 14 in a launch tube 16. FIGS. 1, 3, 4 and 5 of the drawings show the action of the obturator at successive points in the travel of missile 14 out of the launch tube.

The obturator is a plate-like member which has a central opening 18 for sealing around the exit 20 of the rocket motor nozzle 22 and an outer periphery 24 for sealing against the walls of the launch tube 16, as indicated in FIG. 1. The shape of the outer periphery is shown as square in FIG. 2, but it will be understood that any peripheral shape is possible dependent on the cross-sectional shape of the launch tube. Similarly, although one central opening 18 is shown in the drawings for a vehicle having a single exhaust nozzle, more than one opening will be provided for sealing around the exhaust exits of vehicles having multiple exhaust nozzles.

As shown in FIG. 1, the obturator 10 is preferably of dish-like shape having an outer raised lip 25 with a downturned rim 26 for frictional engagement and sealing with the launch tube walls. It can be seen that the sealing rim is designed so that pressure applied to the undersurface of the cover member will deform it upward into closer sealing engagement with the walls of the launch tube. The central opening 18 may also be provided with a raised lip or rim for sealing against the nozzle exit 20.

The cover member is made of a suitable ablative material capable of withstanding the heat of the exhaust gases and the pressure in the exhaust tube during launch or a restrained rocket firing without launch. It may be of a lightweight, semi-flexible construction or may be made more rigid and self-supporting by means of a metallic substructure which is embedded in the ablative material in a laminated construction. In the latter case, the metallic substructure will be scored or formed in separate segments to allow the member to deform as it is released from the missile, as explained in more detail below.

Preferably the obturator or cover member is not physically attached to the base of the missile but is a sufficiently close fit in the launch tube to remain in the position shown in FIG. 1 prior to launch. Once exhaust gases are released, it will be urged against the base of the missile by the pressure of the recirculating gases, as indicated by the arrows in FIG. 1. However, the obturator may, if necessary, be lightly attached to the rocket base around its central opening 18, by means of a suitable adhesive which will break away as soon as a predetermined force is applied to the joint.

Figure 6A:
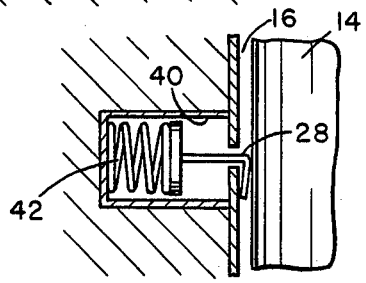
FIGS. 6A and 6B illustrate a modification on which the release hooks are spring-mounted.
Figure 6B:
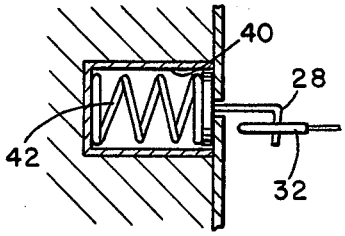

The obturator apparatus includes a release assembly for ensuring that the obturator is contained in the launch tube as the missile exits. The release assembly comprises a first part for mounting adjacent the top end of the launch tube, and a second, linking part mounted at the outer periphery of the obturator itself. In the preferred embodiment of the invention shown in the drawings, the first part of the release assembly or arrangement comprises downwardly facing hooks 28 (see FIGS. 3 to 5) which are mounted adjacent the top end 30 of the launch tube, while the second part of the release assembly comprises corresponding rings 32 mounted at spaced intervals around the outer edge of the obturator in alignment with respective hooks at the upper end of the tube. The hooks 28 will not interfere with the travel of the missile. FIGS. 6A and 6B show a modification in which the hooks 28 are mounted in blind bores 40 in the launch tube walls and are loaded by springs 42 into an extended position projecting out of the bore 40. The hooks deflect into the launch tube wall if missile skin contact is made (see FIG. 6A) and are urged out by the springs 40 to engage rings 32 as shown in Figure 6B once the missile has passed. Although in the embodiment shown in the drawings the release assembly comprises cooperating rings and hooks, alternative release arrangements may be used.

In one alternative arrangement, the release assembly may comprise lanyards or lines secured at one end to the launch tube wall and at the opposite end to the center of the obturator, for linking the obturator to the launch tube wall and pulling on the obturator center region for release as the missile exits the tube.

The rings 32 are attached to lines or lanyards 34 which are firmly secured at their opposite ends to the central area of the obturator adjacent opening 18 by suitable securing means indicated generally at 35. The lines may be of wire or the like, and may be secured by light adhesive to the undersurface of the obturator as shown in FIGS. 1 and 2 or may be embedded in the ablative material of the obturator for added protection from the exhaust gases.

The launch sequence of a missile with an obturator as shown in the drawings will now be described. It will be understood that the sequence described will in practice take only a part of a second from start to finish. In FIG. 1 of the drawings, a point immediately after ignition of the rocket is shown. The exhaust gases recirculating in the launch tube beneath the obturator will urge the obturator against the undersurface of the missile so that it is shape-molded against the base region, and both the missile and the obturator will start to accelerate up the tube together. The obturator will protect the base of the missile from the heat of the recirculating flow, and will also restrict or prevent rocket exhaust gases from recirculating around the missile from below the missile into the space between the missile and launch tube, because of the seal between the obturator and the launch tube walls. The seal does not have to be perfect, but will act to retain most of the recirculating exhaust gases in the space below the missile. The pressure force of the recirculating flow will augment the normal thrust of the rocket.

Figure 3:
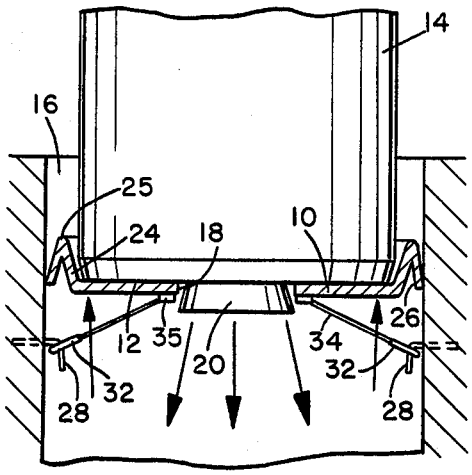
FIG. 3 is a view similar to a portion of FIG. 1, showing the point at which the obturator is released.
Figure 4:
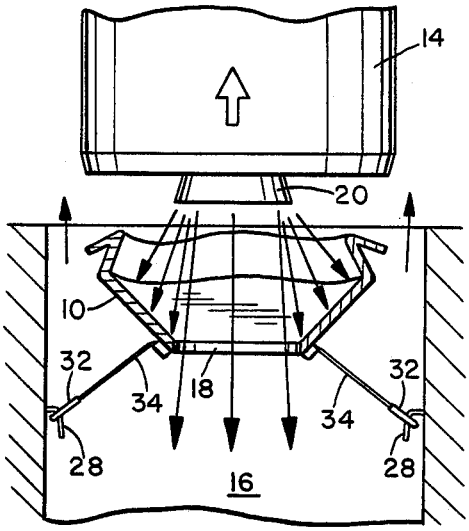
FIG. 4 is a similar view showing the missile leaving the launch tube and the exhaust decelerating the obturator.
Figure 5:
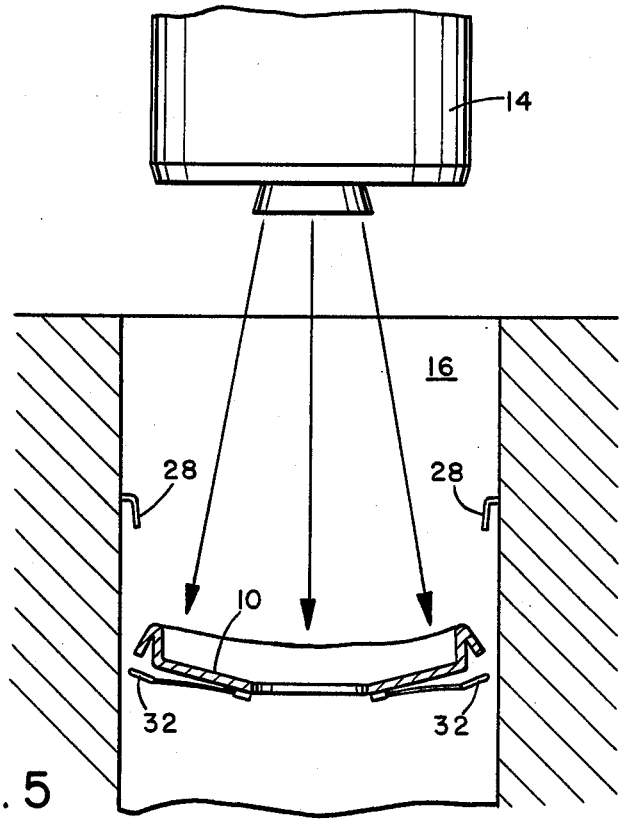
FIG. 5 is a similar view showing the obturator being accelerated back down the launch tube.

Thus the obturator and missile accelerate together up the launch tube until the rings 32 of the release assembly are caught on the hooks 28, as indicated in FIG. 3. The lines 34 will be torn away from the base of the obturator by the acceleration forces, but will still be attached at their inner ends to the center of the obturator surface by the securing means 35 which will be of sufficient strength to withstand the acceleration forces. The obturator surface near the launch tube will continue to move upwards with the missile under the pressure of the backflowing exhaust gases, as indicated by the arrows in FIG. 3. However, since the lines 34 are still attached to the center area of the obturator surface near the seal, the center will be pulled back away from the nozzle exit as soon as the lines become taut. The force will be sufficient to break any adhesive connection between the center of the obturator and the base of the missile. As soon as it breaks away from the missile exit nozzle, the rocket exhaust will immediately impinge on the lip seal, further releasing and decelerating the obturator center region. At the same time, the outer region of the obturator is still accelerating upward; and seal against the launch tube wall is released (because of the distortion of the obturator); and the upward pressure on the obturator decays. The exhaust gases will impinge directly on the upper surface of the obturator as shown in FIG. 4. This will act to force the obturator back down the launch tube, as shown in FIG. 5.

Thus the obturator and release arrangement described above provides a seal across the base of a missile to the walls of the launch tube during the entire movement of the missile up the tube, and also retains the obturator surface in the tube so that no debris will be left around the tube after launch. The arrangement ensures that the obturator is forced back down the tube once it is detached from the rocket nozzle. The obturator protects the base region of the missile from heat damage during launch and also seals against backflowing of exhaust gases around the missile in the launch tube.

Although a preferred embodiment of the invention has been described above by way of example only, it will be understood by those skilled in the field that modifications may be made to the disclosed embodiment without departing from the scope of the invention, which is defined by the appended claims.

I claim:

1. A rocket exhaust recirculation obturator apparatus for sealing a launch tube around an exhaust propelled vehicle, comprising:

a cover member for extending across the base of an exhaust propelled vehicle in a launch tube, the member having at least one opening for sealing around a rocket motor nozzle exit in the base of the vehicle and an outer periphery for sealing against the walls of the launch tube and being moveable up the launch tube with the vehicle under the pressure of recirculating exhaust gases; and release means for releasing the cover member from the vehicle as the vehicle exits the launch tube and retaining the cover member in the launch tube by linking with the cover member at least when the vehicle is leaving the launch tube to pull the cover member away from the vehicle.

2. The apparatus as claimed in claim 1, wherein the cover member is adhesively secured to the base region of the vehicle around its opening.

3. The apparatus as claimed in claim 1, further comprising linking means mounted around the outer periphery of the cover member for linking engagement with the release means as the vehicle exits the launch tube.

4. The apparatus as claimed in claim 3 wherein the release means comprises spaced downwardly facing hooks mounted in the launch tube adjacent the exit, and the linking means comprises spaced rings mounted around the periphery of the cover member in alignment with the hooks for being captured by the hooks as the vehicle leaves the launch tube.

5. The apparatus as claimed in claim 4, including a series of lines, each secured at one end to the undersurface of the cover member adjacent its opening and secured at the opposite end to a respective one of the hooks.

* * * * *